US005562283A

United States Patent [19]

Davis et al.

[11] Patent Number: 5,562,283

[45] Date of Patent: Oct. 8, 1996

[54] SPORTS RACQUET HAVING POWER RING

[75] Inventors: Stephen J. Davis, Washington Crossing, Pa.; Richard Janes, Burlington Twp., N.J.

[73] Assignee: Prince Sports Group, Inc., Bordentown, N.J.

[21] Appl. No.: 438,981

[22] Filed: May 11, 1995

[51] Int. Cl.[6] ..... A63B 49/02; A63B 51/00

[52] U.S. Cl. ..... 273/73 G

[58] Field of Search ..... 273/73 R, 73 C, 273/73 D, 73 G

[56] References Cited

U.S. PATENT DOCUMENTS

| | | | |
|---|---|---|---|
| 472,659 | 4/1892 | Malings | 273/73 G |
| 4,247,103 | 1/1981 | Garver | 273/73 G |
| 4,322,076 | 3/1982 | Bertram et al. . | |
| 4,333,650 | 6/1982 | Soong . | |
| 4,437,662 | 3/1984 | Soong | 273/73 G X |
| 4,512,575 | 4/1985 | Tzeng . | |
| 4,725,059 | 2/1988 | Du Gardin et al. | 273/73 G |
| 4,798,382 | 1/1989 | Janes . | |
| 4,875,679 | 10/1989 | Movilliat et al. | 273/73 C X |
| 4,964,635 | 10/1990 | Fitzgerald | 273/73 G X |
| 4,988,101 | 1/1991 | Soong | 273/73 G X |
| 5,110,125 | 5/1992 | Blanc | 273/73 G X |
| 5,137,273 | 8/1992 | Jseng . | |
| 5,141,228 | 8/1992 | Soong | 273/73 G X |
| 5,255,912 | 10/1993 | Tseng | 273/73 G |
| 5,306,004 | 4/1994 | Soong | 273/73 D X |

FOREIGN PATENT DOCUMENTS

| | | | |
|---|---|---|---|
| 2455906 | 1/1981 | France | 273/73 G |
| 2920680 | 12/1980 | Germany | 273/73 G |

*Primary Examiner*—William E. Stoll
*Attorney, Agent, or Firm*—White & Case

[57] ABSTRACT

A sports racquet includes a power ring, spanning the throat region of the head, which has an arcuate bearing surface facing away from the outer head portion of the racquet. The bearing surface bows in the direction of the stringing area. The lower ends of the main strings wrap about the bearing surface of the power ring, and the strings extend outwardly in a fan shape configuration to frame. The power ring has the effect of shortening the center strings, and lengthening the outlying main strings, so that the power provided by the strings is more uniform over the string bed.

10 Claims, 3 Drawing Sheets

SPORTS RACQUET HAVING POWER RING

FIELD OF INVENTION

The present invention relates to sports racquets such as racquetball, squash, and tennis racquets.

BACKGROUND OF THE INVENTION

Sports racquet frames include a head, which supports interwoven main and cross strings for hitting a ball, and a handle which is gripped by the player. The conventional method of string placement and support is to drill holes through the racquet frame, and secure the strings in the string holes so that the main strings extend parallel to the longitudinal axis, and the cross strings extend perpendicular to the racquet axis.

One of the problems of conventional sports racquets is that the power, or coefficient of restitution, varies at different locations on the string bed. For example, due to the fact that the typical racquet head has a generally elliptical shape, the laterally offset, outlying main strings are much shorter than main strings which are located closer to the center of the racquet head. The result is that the racquet has greater power near the longitudinal axis than at laterally offset locations.

This is exactly the opposite, however, of what is desirable. When the ball hits the string bed laterally off-center, the racquet tends to twist in the player's hand, resulting in a loss of power for the return stroke. Yet, the string bed, rather than providing greater power in these regions which might offset some of the twisting movement, also provides less power due to the shorter main string lengths.

The power of the racquet also tends to be non-uniform along the length of the racquet, decreasing toward the outer tip of the racquet. This is due to two reasons. First, the further out on the string bed the ball hits, the greater the bending moment about the handle. Second, when the ball hits the racquet at a location away from the center of gravity, a rotation is imparted to the racquet, which absorbs energy and reduces power, i.e., the amount of energy returned to the ball. The further out on the racquet the ball lands, the greater the rotation imparted to the racquet.

It is difficult in racquet sports to ensure that the ball hits the racquet strings at exactly the same spot each time. Thus, for two identical swings, the ball will rebound at different speeds depending upon where it contacts the strings. This means that the distance the ball will travel before hitting the court varies, and the player must therefore allow for a greater margin of error to account for inaccuracies in the return shot.

Commonly owned Head U.S. Pat. No. 3,999,756 discloses a string pattern that compensates for the non-uniform power distribution across the string bed by varying the spacing between strings. Head discloses that, due to their shorter lengths, the strings nearer to the racquet frame are stiffer than the strings in the middle of the string bed, e.g., the center main strings. Head discloses that, by increasing the string density near the center of the racquet, the string bed will have a more uniform feel.

It has also previously been proposed to provide racquetball racquets with a "sunburst", or fan-shape string pattern, in which the distance between adjacent main strings increases toward the outer end of the racquet. This has the effect of lengthening the outlying main strings slightly, and therefore acts to reduce somewhat the variation in power across the strung surface. The distance by which the lower ends of the strings can converge, however, is limited by the fact that only so many holes can be drilled into the frame, in a confined area, without weakening the frame to the point that the racquet fails during play. Thus, known sunburst patterns have relatively little effect in compensating for unequal main string lengths.

There has also been at least one proposal to compensate for the variation of power along the axis of the racquet. Commonly owned Davis U.S. Pat. No. 5,037,098 discloses a sports racquet frame in which the cross-sectional height of the frame, in a direction perpendicular to the string bed, is maximum at the tip and decreases continuously toward the handle. The result is a frame which becomes increasingly stiff toward the tip, helping to compensate for the increased bending moment.

It would be desirable to provide a string bed pattern which at the same time produces more uniform power characteristics both across the string bed and along the racquet axis.

SUMMARY OF THE INVENTION

The present invention is a sports racquet, for example a tennis, squash, or racquetball racquet, which comprises a frame member including a generally elliptical outer head portion, wherein opposite ends of said frame member converge in a throat region. A power ring spans the frame member in the throat region so that the frame member and power ring define a stringing area for receiving strings.

The power ring has an arcuate bearing surface, facing away from the stringing area, which bows in the direction of the stringing area. Preferably, the power ring is circular or elliptical in cross-section so that the bearing surface cross-section is approximately semicircular. A plurality of interwoven main strings and cross strings are disposed in the stringing area. The lower ends of at least most of the main strings wrap about the bearing surface of the power ring. The main strings extend from the power ring at diverging angles, and are secured to the outer head portion in locations producing a generally fan shape configuration.

Preferably, the upper ends of the main strings are secured in string holes in the frame, which are located so that main strings are provided across substantially all of the stringing area. Preferably, this is done by distributing main string holes from about the 9 o'clock position to the 3 o'clock position on the outer head portion.

When the racquet is strung, the tension on the main strings draws each main string lower end against a region of the bearing surface representing the minimum distance between opposite ends of the respective string. Such region will lie perpendicular to the direction of string tension. The bearing surface is curved such that adjacent lower main string ends bear against regions on the bearing surface that are spaced at predetermined distances from one another. Preferably, the bearing surface has a span length, between opposite sides of the frame, which is at least the sum of the diameters of the main strings, and has a curvature that maintains a minimum predetermined spacing between adjacent strings. Most preferably, the span length of the power ring is kept at a minimum, so that the power ring can be located just above the throat joint which will result in the maximum string length.

In a preferred embodiment, the side portions of the frame connecting the elliptical outer head portion with the throat, have a relatively small curvature, i.e., are generally straight. The outermost main string on each side of the racquet is spaced from, and generally parallel to, the frame sides. In one embodiment, the outermost main strings extend from the power ring to the outer head portion. However, if desired, the outmost mains strings can terminate in the lower end of the head. In such a case, it may be more desirable to secure the lower ends of the outermost main strings in string holes in the frame.

The present invention increases the lengths of the outlying main strings, and in so doing increases the power response in the laterally offset areas of the string bed. The power ring also has the effect, due to its curvature, of decreasing the lengths of the center main strings, and in so doing decreasing the power provided in such region. As a result, the variation in power across the face of the string bed is reduced compared to conventional stringing patterns, including sunburst patterns.

The invention has a further advantage in that the string density decreases toward the outer regions of the string bed and increases toward the throat region. As a result, the power produced by the main strings increases as the ball is hit further out on the string bed and, due to the higher string density above the throat region, decreases in the lower regions of the string bed. The present invention thus has the effect of making power more uniform not only across the string bed, but along the axis of the string bed as well, i.e., over the entire string bed.

The fact that the lower ends of the main strings, which wrap about the power ring, are closely spaced also has a desirable effect in reducing the amount of string movement.

In racquetball racquets and some squash racquets, all of the main string lower ends are supported in string holes drilled into the sides of the frames. In tennis racquets, some of the lower main string holes are drilled into the sides of the frame, and others (the string holes for the center main strings) are drilled into a throat bridge which spans the throat area.

Drilling string holes in the sides of the frame weakens the frame. String holes for the lower ends of the main strings are particularly undesirable, because they are located in a region of large bending stress of the frame. However, with conventional racquets there is no other practical way to secure the string ends.

Due to the curvature of the power ring bearing surface, the lower ends of the strings seat at the desired location using the string's own tension acting in conjunction with the geometric shape of the bearing surface. Thus, the need for string holes for the lower ends of the main strings is eliminated. As a result of eliminating the lower string holes, the frame in the lower region of the racquet head is strengthened, reducing the possibility of frame failure in this region.

The elimination of the lower main string holes in the racquet sides, with the concurrent elimination of the accompanying string groove, has the further advantage of increasing the amount of flat surface area on the sides of the racquet where cosmetic designs, logos, or other information can be placed.

Preferably, the lower ends of the main strings wrap around the power ring bearing surface, without string holes, and are securely retained in place due to the curvature of the bearing surface. However, if desired string holes or string guide grooves may be formed in the power ring to further secure the lower string ends.

A racquet according to the present invention is easy to string, due to the fact that the lower ends of the strings are merely wrapped about the power ring, in contrast to conventional racquets where the strings need to be threaded through grommet pegs.

In stringing racquets with conventional stringing machines, the lower end of the head can be damaged if the tension head of the stringing machine scrapes against the frame surface. According to the present invention, a method is disclosed for stringing the racquet by simultaneously pulling two main strings at a time from the top of the racquet head, which eliminates the need for the stringing machine to engage the lower end of the head.

For a better understanding of the invention, reference is made to the following detailed description of a preferred embodiment, taken in conjunction with the drawings accompanying the application.

DETAILED DESCRIPTION OF PREFERRED EMBODIMENTS

Figure 1:
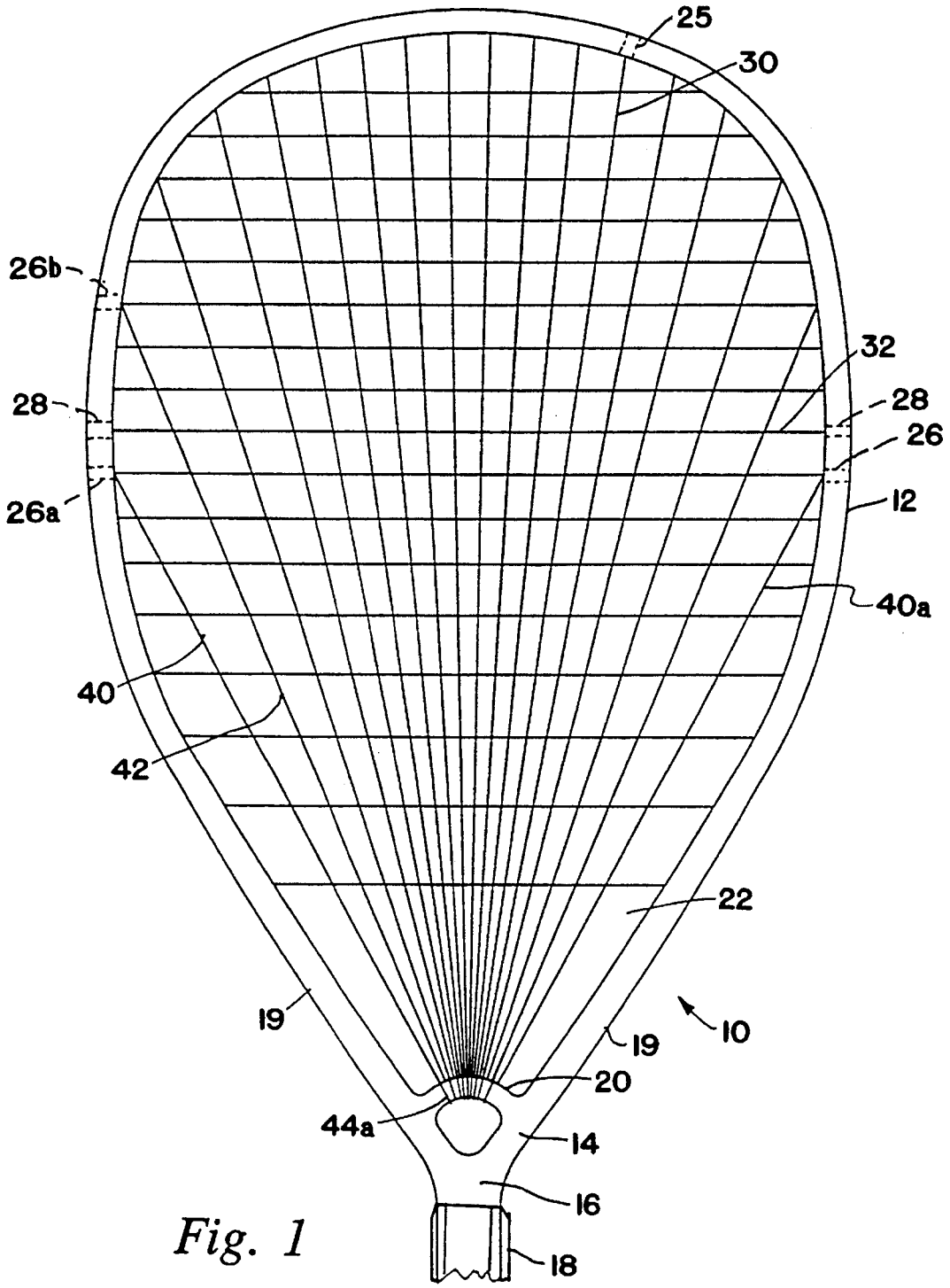
FIG. 1 is a front view of a racquetball racquet according to the invention.

FIG. 1 shows a racquetball racquet 10 having a frame forming a generally elliptical outer head portion 12, with the opposite ends 19 of the frame converging into a throat region 14 and meeting at a throat joint 16. Below the throat joint 16, the racquet is provided with a handle 18 in the conventional manner. In the example shown, the opposite ends 19 of the frame extend from the elliptical outer head portion 12 to the throat joint 16 with only a slight curvature, i.e., generally linearly.

Figure 2:
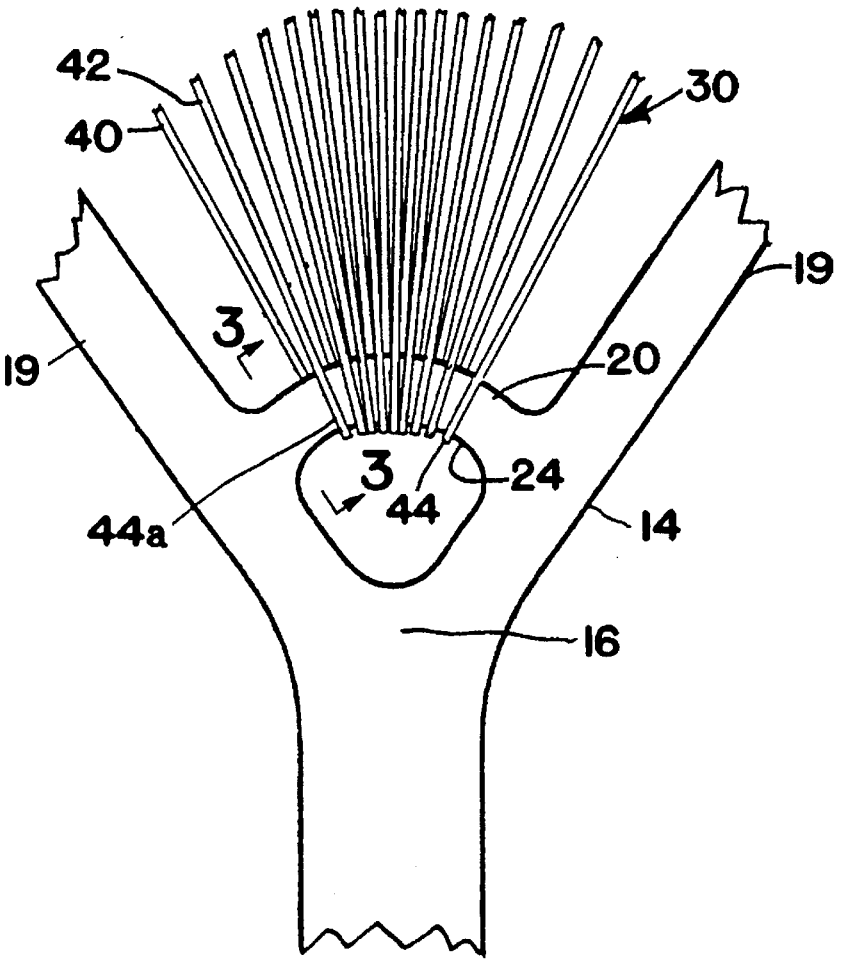
FIG. 2 is a full scale view of the throat section of the racquet.
Figure 3:
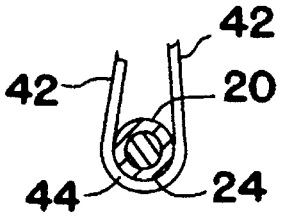
FIG. 3 is sectional view, taken through lines 3—3 of FIG. 2, of the power ring.

A power ring 20 spans the frame in the throat region 14, just above the throat joint 16, so as to enclose, with the frame members 12, 19, a stringing area 22 for receiving strings. Referring particularly to FIGS. 2–3, the power ring 20 has an arcuate, inner ring bearing surface 24 facing in a direction away from the outer head portion 12 (i.e., toward the handle 18). The curved bearing surface 24 spans the two sides of the frame, and bows inwardly toward the stringing area 22. As shown FIG. 3, in cross-section the ring 20 is circular, such that the bearing surface 24 is semicircular. However, other shapes may be employed.

A plurality of interwoven main strings 30 and cross strings 32 are provided in the stringing area 22. The outer head portion 12 of the frame has a plurality of upper main string holes 25 for receiving the upper ends of the main strings 30. As shown, the main string holes 25 are provided from approximately the 9 o'clock position to the 3 o'clock position, so that main strings 30 are provided across substantially all of the stringing area 22, i.e., across the normal hitting area.

Referring to FIG. 1, in the illustrative example the ends 19 of the frame extend from the elliptical outer head portion 12 to the throat joint 16 at a median angle of approximately 32° relative to the racquet axis. The outermost main strings 40, 40*a* extend from the power ring 20 spaced from, but generally parallel to the ends 19 of the frame, at angles of approximately 29°. Thus, as shown in FIG. 1, the main strings fan out at an angle so as substantially to fill the stringing area 22. In the example of a racquetball racquet shown in FIG. 1, the outlying main strings and frame sides above the throat joint diverge at an angle of about ±30° from the racquet axis, but other angles may be employed, and may be more preferably depending upon the size hitting desired, or depending upon the type of racquet (e.g., tennis or squash).

The outer head portion 12 and end portions 19 are also provided with a plurality of cross string holes 28 for receiving the opposite ends of the cross strings 32. As shown, in some cases a string hole 26 may receive both a cross string 32 and a main string 30. The cross strings 32 are secured in the racquet frame in the customary manner.

The main strings extend from the string holes 25 to the power ring 20, wrap around the power ring 20, and return to the outer head portion 12 of the frame. Pairs of adjacent strings, e.g., 40, 42 (FIGS. 2–3), are connected by string end 44, which wraps around the curved bearing surface 24 of the power ring 20. The racquet may be strung with a plurality of individual pairs of main strings, but preferably is strung with one continuous main string.

Figure 4B:
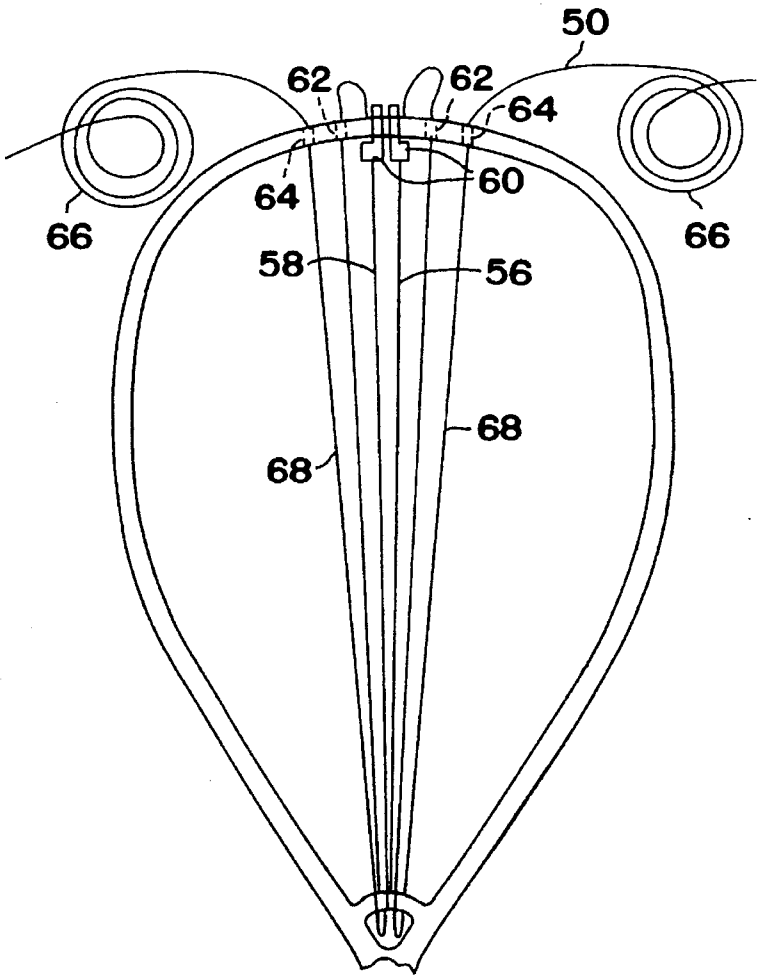
FIGS. 4*a* and 4*b* are front views of the racquet of FIG. 1 during two stages of stringing.
Figure 4A:
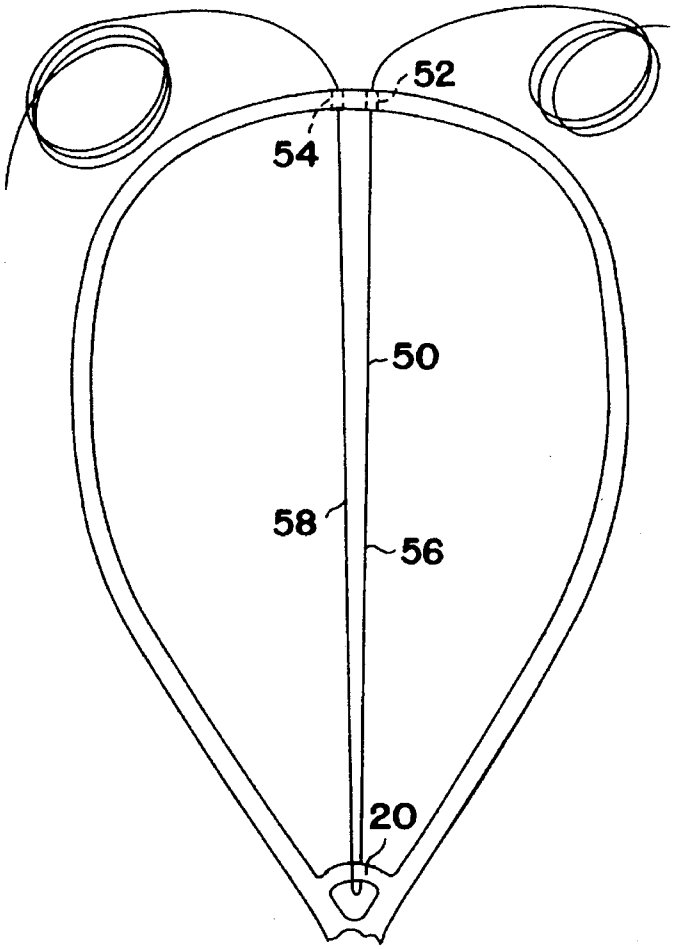

FIGS. 4*a* and 4*b* illustrate a preferred method of stringing the main strings using a single string 50 of sufficient length. One end of the string 50 is inserted through one of the center main string holes 52, looped around the power ring 20, and pulled through the other center main string hole 54 until there is an equal length of string exiting each of the two holes 52, 54.

Referring to FIG. 4*b*, the first two main strings 56, 58 are then pulled taut, e.g., using a racquet stringing machine, and clamped as shown schematically by elements 60. Thereafter the two free ends of the string 50 are threaded through the next outlying pair of main string holes 62, passed around the power ring 20, and out through the third pair of outlying string holes 64, again leaving a length 66 of string on each side.

Once this is done, the strings 68 are tensioned by the stringing machine and clamped, and the process is repeated until all the main strings 30 have been strung in the manner shown in FIG. 1. The cross strings 32 may be strung either prior to or after stringing the main strings 30.

Referring to FIGS. 1–2, as the main strings 30 are tensioned, the string ends 44 are drawn against the bearing surface 24, and move to a region representing the minimum distance between opposite ends of the respective string, as determined by the curvature of the bearing surface. In other words, the string will seat in the portion of the bearing surface 24 lying perpendicular to the direction of string tension. Thus, in the case of string pair 40, 42, if the string end 44*a* is initially positioned either to the right or to the left of the position shown in FIG. 2, as soon as the strings 40, 42 are tensioned, the string end 44*a* will slide to the position shown, because it represents the minimum distance from the power ring 20 to the string holes 26*a*, 26*b* for strings 40 and 42.

Due to the fact that the main strings 30 fan outwardly, and due to the curvature of the power ring 20, as shown in FIG. 2 each string end 44 will be positioned in a region displaced relative to the adjoining string connecting section. Preferably, the curvature of the ring 20 is selected so as to allow the string ends 44 to seat against the bearing surface at a predetermined distance from one another, without contacting each other, or at least without substantial contact.

In the exemplary embodiment shown, the opposite ends of the power ring 20 are positioned approximately ¾ inch above the top of the throat joint 16, and the bearing surface 24 of the power ring 20 has a radius of curvature generally of 1 inch. However, as discussed above the radius of curvature of the bearing surface 24 is chosen so as to maintain a predetermined spacing between the string ends 44, so that the connecting portions between strings are relatively close together (e.g., 1 mm) but do not overlap. This may entail increasing the radius of curvature in the center of the power ring 20 (i.e., decreasing the curvature) to ensure that the string ends 44 do not bunch too close together, and decreasing the radius of curvature (i.e., providing a sharpers curve) toward the outside of the ring to ensure that the string ends do not become spaced too far apart By doing so, the string ends 44 occupy a minimum space laterally, and the length of the power ring 20 can be kept to a minimum and placed just above the throat joint. By locating the power ring 20 just above the throat joint 16, the main strings 30 occupy substantially all of the stringing area 22.

The present invention may be employed in sports racquets made from any suitable material, for example, a fiber-reinforced composite or metal hollow tube profile. In the former case, the frame is molded in a customary manner, with the power ring 20 molded simultaneously in the same manner as the throat bridge of a tennis racquet. If the frame member is made of metal tubing, a hollow tubular metal power ring may be secured to the sides of the frame in a manner comparable to a metal throat bridge. Such racquet forming methods are well known and need not be described further here. Alternatively, the racquet frame can be made of metal, with a graphite power ring. The ends of the graphite power ring are secured to the sides of the metal frame in the same manner as currently employed to make metal tennis racquets with fused graphite throat bridges.

If desired, the present invention may be used with a constant taper frame as disclosed in commonly owned Davis U.S. Pat. No. 5,037,098. In this manner, both the frame and the stringing system will act to even the power distribution along the length of the racquet.

In the case of frames made of composite material, the upper ends of the main strings are secured in a conventional bumper strip, and the cross strings are secured in conventional grommet strips, made of hard nylon or other suitable material, to prevent damage to the strings and frame at the edges of the string holes. Due to the large contact area between the power ring bearing surface and each string, and the absence of high stress areas such as string hole edges, a protective hard plastic strip is not required around the power ring. However, if desired a friction reducing material, such as acetal resin (e.g., Delrin) or Teflon, may be positioned between the lower string ends and the bearing surface. When the strings are tensioned, the friction reducing material will help ensure even string tension between adjacent main strings.

The foregoing represents a preferred embodiment of the invention. Variations and modifications will be apparent to persons skilled in the art, without departing from the inventive concepts disclosed herein. All such modifications and variations are intended to be within the skill of the art, as defined in the following claims.

We claim:

1. A sports racquet comprising:

a frame member including an outer head portion, wherein opposite ends of the frame member converge in a throat region and meet at a throat joint;

a power ring spanning the opposite ends in the throat region, wherein the frame member and power ring define a stringing area for receiving strings; wherein the power ring has an at least generally arcuate, inner ring bearing surface facing away from the outer head portion which bows in a direction toward the stringing area; and a plurality of interwoven main strings and cross strings, wherein the main strings have upper and lower ends, wherein the lower ends of at least most of the main strings include a connecting section that wraps around the bearing surface and connects with an adjoining main string, wherein such main strings first contact the bearing surface along portions of the bearing surface that are at least generally tangent to the direction of the respective string, wherein the connecting sections are movable along the inner ring bearing surface so that tension applied to the main strings draws each connecting section against a region of the bearing surface representing the minimum distance between the connecting section and the upper ends of the main strings associated with such connecting section, and the strings are thereby self-seating when tension is applied, and wherein the upper ends of the main strings are secured to the outer head portion in locations producing a generally fan shape configuration.

2. A sports racquet as defined in claim 1, wherein said power ring is located immediately above the throat joint, wherein the lower ends of all the main strings include connecting sections that wrap around the power ring, and wherein the outer head portion includes string holes for securing the upper ends such that main strings are provided across substantially all of the opening.

3. A sports racquet as defined in claim 2, wherein the bearing surface has a curvature such that adjacent main string connecting sections bear against regions on the bearing surface that at least do not substantially overlap.

4. A sports racquet as defined in claim 2, wherein the racquet includes a longitudinal axis, comprising a single main string forming the plurality of main strings and connecting sections, wherein the outer head portion includes pairs of successively outlying upper main string holes, the holes forming each pair lying on opposite sides of the axis, and wherein the racquet is strung by:

(a) passing the main string through one of the upper main string holes of the pair adjacent to the axis, around the power ring, and out through the other upper main string hole of the pair, thereby forming a first main string, a second main string, and a pair of main string free ends exiting the respective pair of upper main string holes;

(b) tensioning the first and second main strings;

(c) passing each main string free end through the next outlying upper main string hole;

(d) directing each free end about the power ring and back out through the next adjacent upper main string hole, forming a third main string, a fourth main string, and a remaining main string free end, on either side of the axis;

(e) tensioning the fourth main strings; and (f) repeating steps (d)–(e) until the main string extends through all the upper main string holes.

5. A sports racquet as defined in claim 1, wherein the bearing surface has a length which is at least the sums of the diameters of the main string lower ends and a curvature such that there is a relatively small, predetermined spacing between connecting sections of adjacent main strings.

6. A sports racquet as defined in claim 5, wherein the length of the power ring, and its distance from the throat joint, are kept to a relative minimum as needed to maintain such predetermined spacing.

7. A sports racquet as defined in claim 6, wherein the main string holes are distributed in the outer head portion substantially between 9 o'clock and 3 o'clock positions.

8. A sports racquet as defined in claim 7, wherein the racquet has a longitudinal axis, and wherein the main strings include a pair of outlying main strings lying on opposite sides of the axis, at angles of approximately ±30° relative thereto.

9. A sports racquet according to claim 6, wherein the inner ring bearing surface bows with a radius of curvature of approximately one inch.

10. A sports racquet as defined in claim 1, wherein the bearing surface is generally semicircular in cross section.

* * * * *